United States Patent [19]

Lee et al.

[11] Patent Number: 4,782,769

[45] Date of Patent: Nov. 8, 1988

[54] APPARATUS FOR PREVENTING CLOGGING OF ROTARY COMBUSTORS BY LOW-MELTING TEMPERATURE METAL

[75] Inventors: Suh Y. Lee, Monroeville; George B. Levin, Pittsburgh, both of Pa.

[73] Assignee: Westinghouse Electric Corp., Pittsburgh, Pa.

[21] Appl. No.: 144,625

[22] Filed: Jan. 11, 1988

Related U.S. Application Data

[63] Continuation of Ser. No. 018,569, Feb. 25, 1987, abandoned.

[51] Int. Cl.[4] ..... F23G 5/06

[52] U.S. Cl. ..... 110/246; 110/250; 432/103

[58] Field of Search ..... 432/99, 103; 110/246, 110/250

[56] References Cited

U.S. PATENT DOCUMENTS

| | | | |
|---|---|---|---|
| 3,744,438 | 7/1973 | Southwick | 110/250 |
| 3,812,620 | 5/1974 | Titus et al. | 110/250 |
| 3,822,651 | 7/1974 | Harris et al. | 110/246 |
| 4,066,024 | 1/1978 | O'Connor | 110/246 |
| 4,226,584 | 10/1980 | Ishikawa | 110/246 |
| 4,280,417 | 7/1981 | Alexandersson | 110/250 |
| 4,655,146 | 4/1987 | Lemelson | 110/246 |
| 4,655,968 | 4/1987 | Queiser et al. | 110/250 |

*Primary Examiner*—Henry C. Yuen

[57] ABSTRACT

A rotary combustor for incinerating solid waste material, such as municipal trash, includes a combustion barrel supplied by air through windboxes underneath the barrel. Molten metal, such as aluminum, which is commonly present in the waste material, drops through perforations in the side wall of the combustion barrel and collects on a heated contact surface in each of the windboxes. The heated contact surface may have a funnel shape and be connected to a heated pipe for transferring the molten metal out of each windbox. Alternatively, the heated element may be attached to the interior surface of each windbox and separated therefrom by heat insulation. In this case, heated airlock doors at the lower end of the windboxes are used to discharge the molten metal from the windboxes.

13 Claims, 5 Drawing Sheets

APPARATUS FOR PREVENTING CLOGGING OF ROTARY COMBUSTORS BY LOW-MELTING TEMPERATURE METAL

This application is a continuation of application Ser. No. 018,569, filed Feb. 25, 1987, now abandoned.

BACKGROUND OF THE INVENTION

1. Field of the Invention

The present invention is related to a rotary combustor, or incinerator, for waste material and, more particularly, to an improvement in windboxes which supply combustion air to a rotary combustor, for preventing clogging of the windboxes by low-melting temperature metals, such as aluminum.

2. Description of the Related Art

Proper disposal of solid waste has become an increasingly serious problem as existing sites for land disposal near capacity and new sites become increasingly difficult to locate while the amount of toxic chemicals, particularly in municipal waste, appears to be increasing. Incineration of combustible solid waste has long been used to reduce the quantity of solid matter needing disposal. One device used for this purpose is a water-cooled rotary combustor which has been used in an increasing number of applications over the last one to two decades. While a rotary combustor is capable of burning most types of combustible waste, ranging from eight-foot long logs to typical kitchen waste, certain problems arise when the waste includes low-melting temperature metals, particularly those used in beverage containers, foil, disposable trays, etc. Thus, municipal solid waste, which includes kitchen waste as well as waste from other sources, contains aluminum in a relatively pure state. The combustion temperature in a rotary combustor reaches well in excess of 660° C., at which pure aluminum melts. Therefore, molten aluminum is formed in the rotary combustor and flows downward, solidifying shortly after leaving the combustor and eventually clogging passageways that provide the air required for combustion.

SUMMARY OF THE INVENTION

An object of the present invention is to provide means for preventing clogging, by resolidified metal, of combustion air passageways in a rotary combustor.

Another object of the present invention is to provide means for removing molten metal from a rotary combustor to prevent clogging problems.

A further object of the present invention is to provide means for separating recyclable aluminum from municipal waste undergoing incineration.

The above-mentioned objects are attained by providing an apparatus for preventing accumulation of molten metal dropping from a combustion barrel and solidifying in a windbox of a rotary combustor. The apparatus comprises a heatable contact surface disposed in the path of the molten metal dropping from the combustion barrel, heating means for heating the contact surface, and heat insulation which separates the heatable contact surface from the windbox. In one embodiment of the present invention, the heatable contact surface has a funnel shape with a downwardly extending tube and is generally disposed in the horizontal center of the windbox. In this embodiment, the apparatus also includes means, such as a pipe coupled and sealed to the downwardly extending tube, for discharging the molten metal from the windbox. The pipe is also heated by the heating means.

In a second embodiment of the present invention, the heat insulation covers a significant portion of the interior surface of the windbox and the heatable contact surface is disposed on the insulation, conforming to the interior surface of the windbox. In this embodiment, the apparatus includes airlock doors, disposed at the lower end of the windbox, having a heated portion abutting the heatable contact surface lining the interior surface of the windbox. The metal is discharged from the windbox by opening the airlock doors one at a time.

These objects, together with other objects and advantages which will be subsequently apparent, reside in the details of construction and operation as more fully hereinafter described and claimed, reference being had to the accompanying drawings forming a part hereof, wherein like reference numerals refer to like parts throughout.

DESCRIPTION OF THE PREFERRED EMBODIMENTS

Figure 1A:
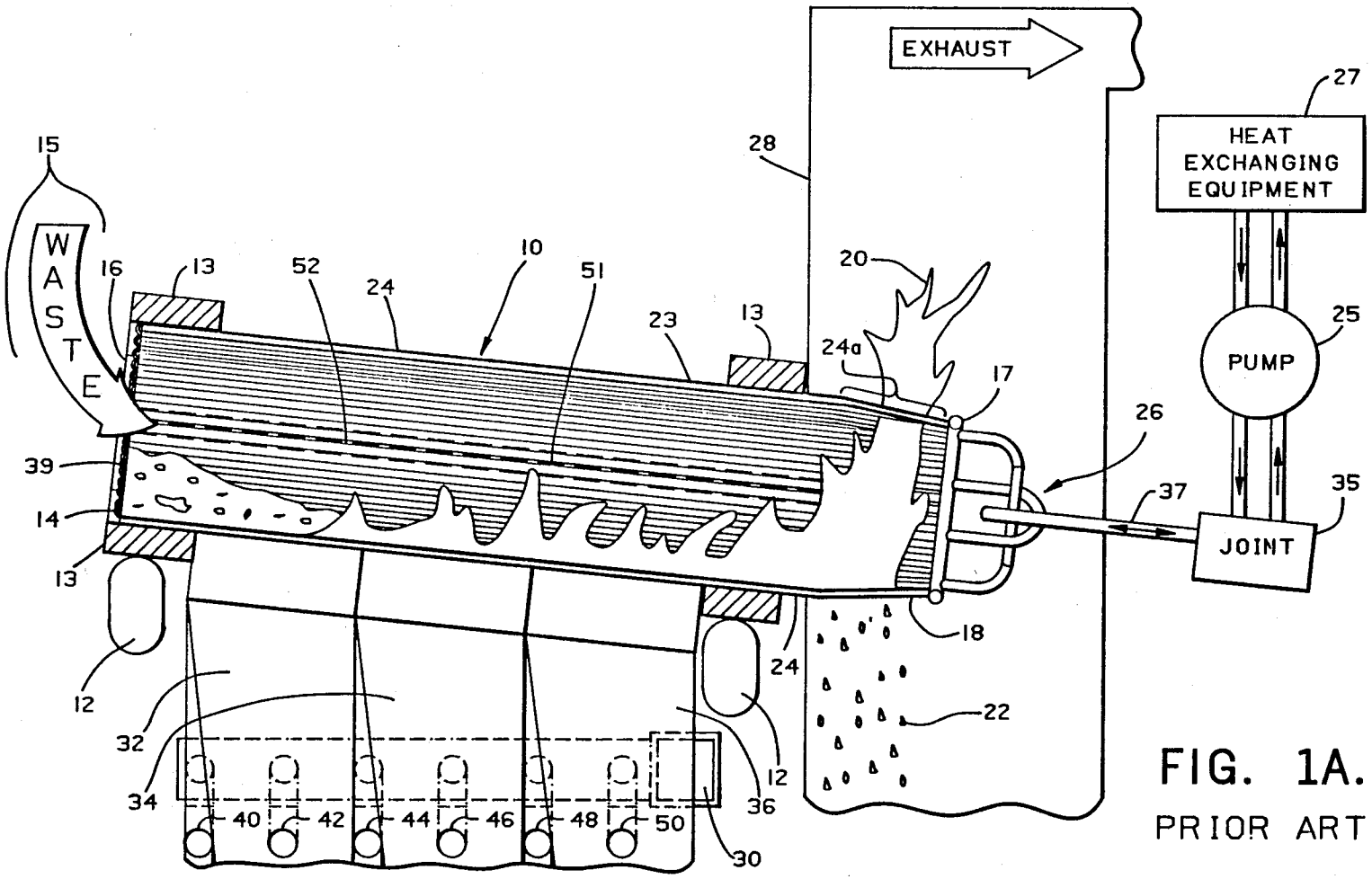
FIG. 1A. PRIOR ART
FIG. 1A is a cross-sectional, side elevational schematic view of a rotary combustor in which the present invention can be utilized.

A conventional water-cooled rotary combustor is illustrated schematically in a cross-sectional, side elevational view in FIG. 1A; the rotary combustor generally includes a combustion barrel 10 having a generally cylindrical side wall 23 formed of longitudinally extending cooling pipes 24 arranged in spaced axial relationship. The cooling pipes 24 are encircled by, and secured to, bands 13 which in turn are supported by rollers 12. The combustion barrel 10 receives solid waste 14 at an input end 16 and discharges heat 20 and solid combustion products 22, e.g., ash, at an exit end 18. The combustion barrel 10 may be rotated by driving the rollers 12 or by a separate ring gear (not shown) affixed to the barrel and driven by a pinion, as disclosed in U.S. Pat. No. 3,822,651 to Harris et al., incorporated herein by reference.

The combustion barrel 10 has a central axis of rotation which is inclined slightly from the horizontal, proceeding downwardly from the input end 16 to the exit end 18. Combustion air is forced into the barrel 10 through gas-porous interconnections 51 between adjacent cooling pipes 24 by windboxes, including windboxes 32, 34 and 36 illustrated in FIG. 1A. The gas-porous interconnections 51 are preferably formed of bar steel perforated by openings 52. The interconnections 51 extend from the input end 16 and along the generally straight axial portions of the pipes 24 to an angled section, or truncated conical section, 24*a* which is received within a flue 28. No interconnections 51 are included in the angled section 24*a*, in which the cooling pipes 24 extend in a somewhat converging relationship to the exit end 18 of the barrel 10. The lack of interconnections 51 in the angled section 24*a* permits flue gas 20 and ash 22 to escape more easily from the barrel 10.

The temperature of cooling pipes 24 is maintained at approximately 275° C. by circulating coolant therethrough. The resulting high-energy coolant is discharged from the barrel 10 via a ring header 17 and supply pipes 26. The high-energy coolant discharged by the supply pipes 26 is circulated by a pump 25 through a rotary joint 35, such as the joint disclosed in Harris et al. '651, to heat exchanging equipment 27 which returns low-energy coolant to the ring header 17 via the pump 25, joint 35 and supply pipes 26. The supply pipes 26 preferably include a double-walled, or coaxial, pipe 37 for connection to the joint 35. The ring header 17 distributes the low-energy coolant received from the heat exchanging equipment 27 to a first set of the cooling pipes 24 which transport the coolant the length of the barrel 10 to return means, such as U-tubes 39, at the input end 16 of the barrel 10. The U-tubes 39 couple the first set of the cooling pipes 24 to a second set of the cooling pipes 24 which return the coolant to the ring header 17 to be discharged to the heat exchanging equipment 27. The heat exchanging equipment 27 may include a boiler, a condenser, connection to a steam driven electrical power generating system, etc. (all not shown), as known in the art.

Figure 1B:
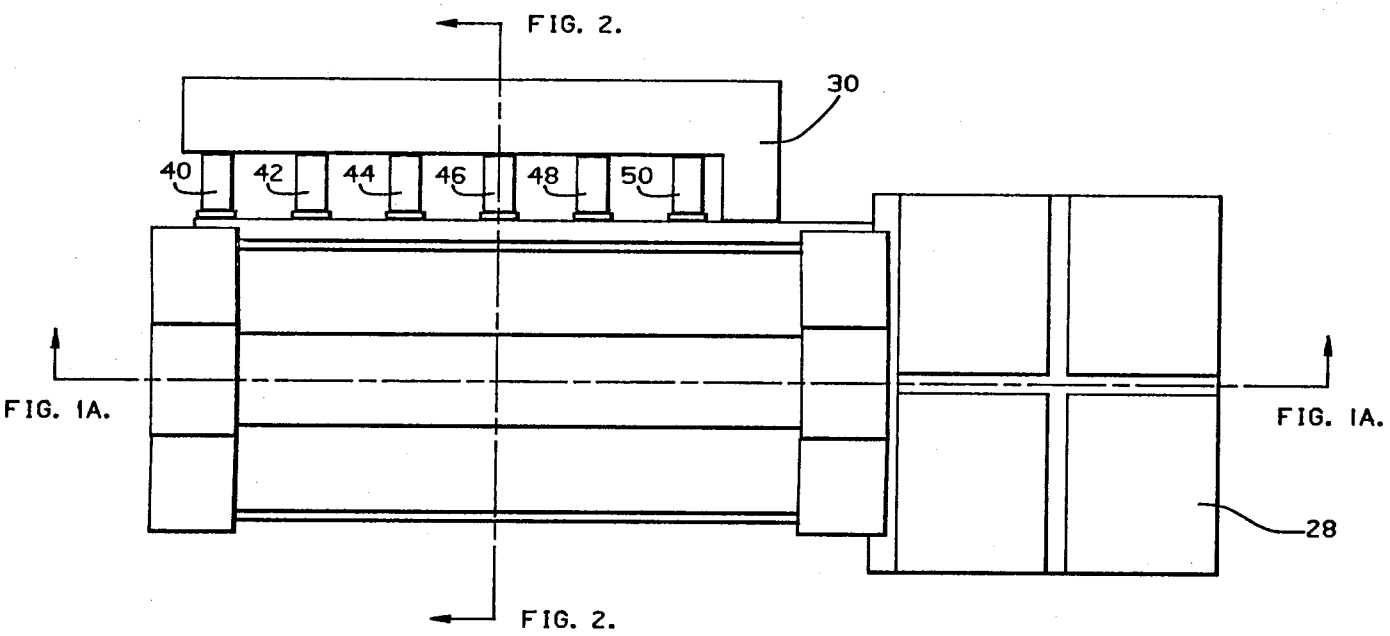
FIG. 1B. PRIOR ART
FIG. 1B is a schematic top plan view of the rotary combustor illustrated in FIG. 1A.
Figure 2:
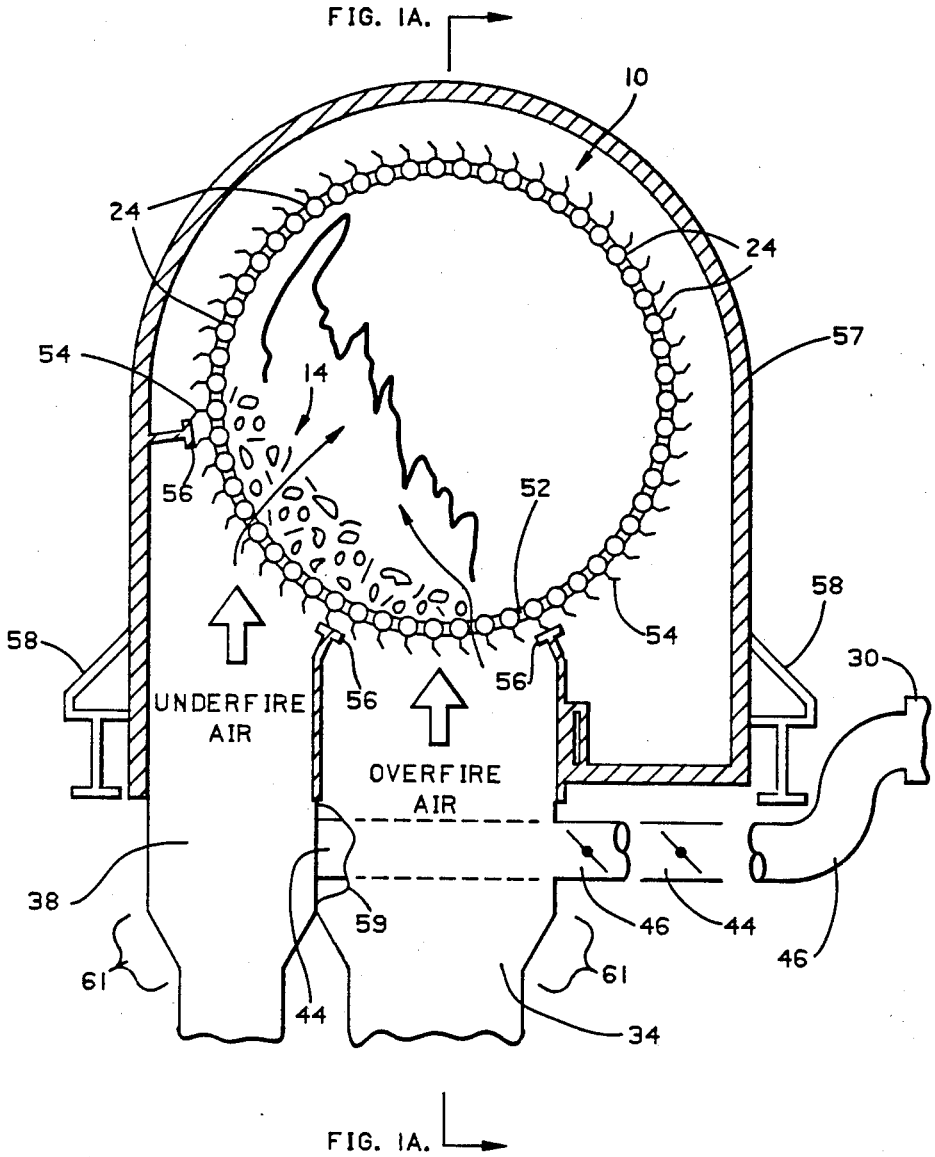
FIG. 2. PRIOR ART
FIG. 2 is a cross-sectional and elevational schematic view of the rotary combustor illustrated in FIG. 1A.

Referring to FIGS. 1A, 1B and 2, the combustion air is supplied to the combustion barrel 10 by an air duct 30 and windboxes 32, 34, 36 and 38. The windboxes 32–38 are disposed underneath the combustion barrel 10 and generally perpendicular to the axis of the generally cylindrical barrel 10. Air is transferred from the duct 30 to the windboxes 32–38 via control ducts 40, 42, . . . , 50, best seen in FIG. 1B. As illustrated in FIG. 2, control duct 46 supplies combustion air from the air duct 30 to the middle "overfire" windbox 34, while control duct 44 supplies combustion air to the middle "underfire" windbox 38. The air supplied by air duct 30 may be preheated by the exhaust from the flue 28 and may be blown by a conventional forced draft fan (not shown). Preferably, the combustion air is drawn from a waste input area 15 to provide a source of ventilation for the waste material 14 being loaded into the combustion barrel 10.

FIG. 2 is a schematic cross-sectional, end elevational view of the conventional rotary combustor illustrated in FIG. 1A. As illustrated in FIG. 2, the combustion barrel 10 is housed within an enclosure 57, not illustrated in FIG. 1A for simplicity, which ensures that the flue gas 20 exits via the flue 28. The enclosure 57 is supported on an appropriate surface by supports 58. A cut-away 59 is provided in FIG. 2 to illustrate a control duct 44 which supplies combustion air to "underfire" windbox 38. As further illustrated in FIG. 1B, control duct 44 lies behind control duct 46 in the plane in which FIG. 2 has been taken.

As viewed in FIG. 2 from the exit end 18 (FIG. 1A), the combustion barrel 10 rotates in a clockwise direction. As a result, the waste material 14 is shifted to the left side of the combustion barrel 10, as seen in FIG. 2. Therefore, above the "overfire" windboxes, e.g., windbox 34, there are usually at least a few openings 52 which are not covered by waste material 14 and thus are able to supply large quantities of air to the top of the pile of waste material 14 to support combustion. On the other hand, the "underfire" windboxes, e.g., windbox 38, direct air to the base of the waste material 14 to aid in combustion. Ordinarily, the waste material 14 is sufficiently large and irregularly shaped so that a sufficient number of the openings 52 are unblocked above the underfire windboxes, permitting air to penetrate into the waste material 14 in the barrel 10.

Typically, the air pressure differential between the windboxes and the barrel 10 is a couple of inches of water, i.e., slightly less than one-tenth (0.1) psi. As illustrated in FIG. 2, seal strips 54 cooperate with windbox edges 56 to afford a pressure seal between the windboxes and the combustion barrel 10. The seal strips 54 extend longitudinally, i.e., in a parallel-axial direction, along and secured to the exterior of the combustion barrel 10, and have a dogleg-shaped cross section as illustrated in FIG. 2. Each of the seal strips 54 is continuous for at least the axial length of one windbox.

Small particulate matter, such as ashes, and liquids, such as molten aluminum, drop through the openings 52 in the interconnections 51. This occurs most often in the windboxes closest to the exit end 18 of the combustion barrel 10. In a combustor with six windboxes, such as the combustor illustrated in the drawings, the greatest accumulation of material occurs in overfire windboxes 34 and 36 (FIG. 1A), underfire windbox 38 (FIG. 2) and the underfire windbox (not shown) closest to the exit end 18. To avoid an excess accumulation of the materials dropping through the openings 52, airlock doors 60 (FIG. 3A) enable the accumulated solid matter to be discharged through the lower end 65 of the windboxes. However, the temperature of the air in the windboxes, even if the air is preheated as described above, is typically 250° C. As a result, the molten aluminum quickly solidifies after dropping through the openings 52 into the windboxes. In a conventional rotary combustor used for incinerating municipal waste, the resolidified aluminum accumulates in the windboxes, particularly at the angled portions 61 (FIG. 2) where the horizontal cross section of the windboxes is reduced. As the resolidified aluminum builds up in this region, the accumulated aluminum constricts the flow of combustion air, eventually preventing the flow of air into the combustion barrel 10.

According to the present invention, such results are avoided by including a heatable contact surface on which the aluminum accumulates as it drops from the combustion barrel 10. The contact surface is maintained at a temperature of at least 660° C. so that the aluminum remains in a molten state. Heat insulation separates the heatable contact surface from the walls of the windbox.

Figure 3B:
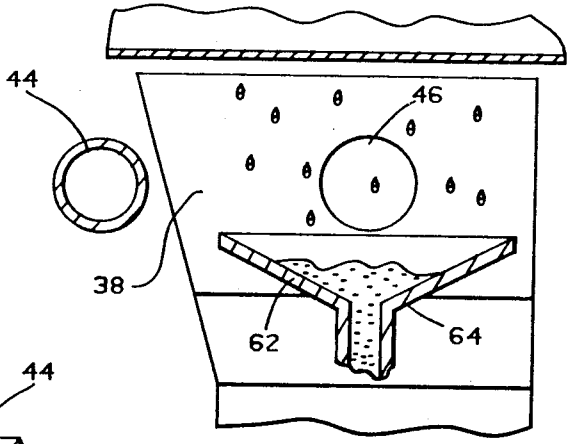
FIG. 3B is a cross-sectional, side elevational schematic view, taken in a plane transverse to that of FIG. 3A, of one of the windboxes shown in FIG. 3A.
Figure 3A:
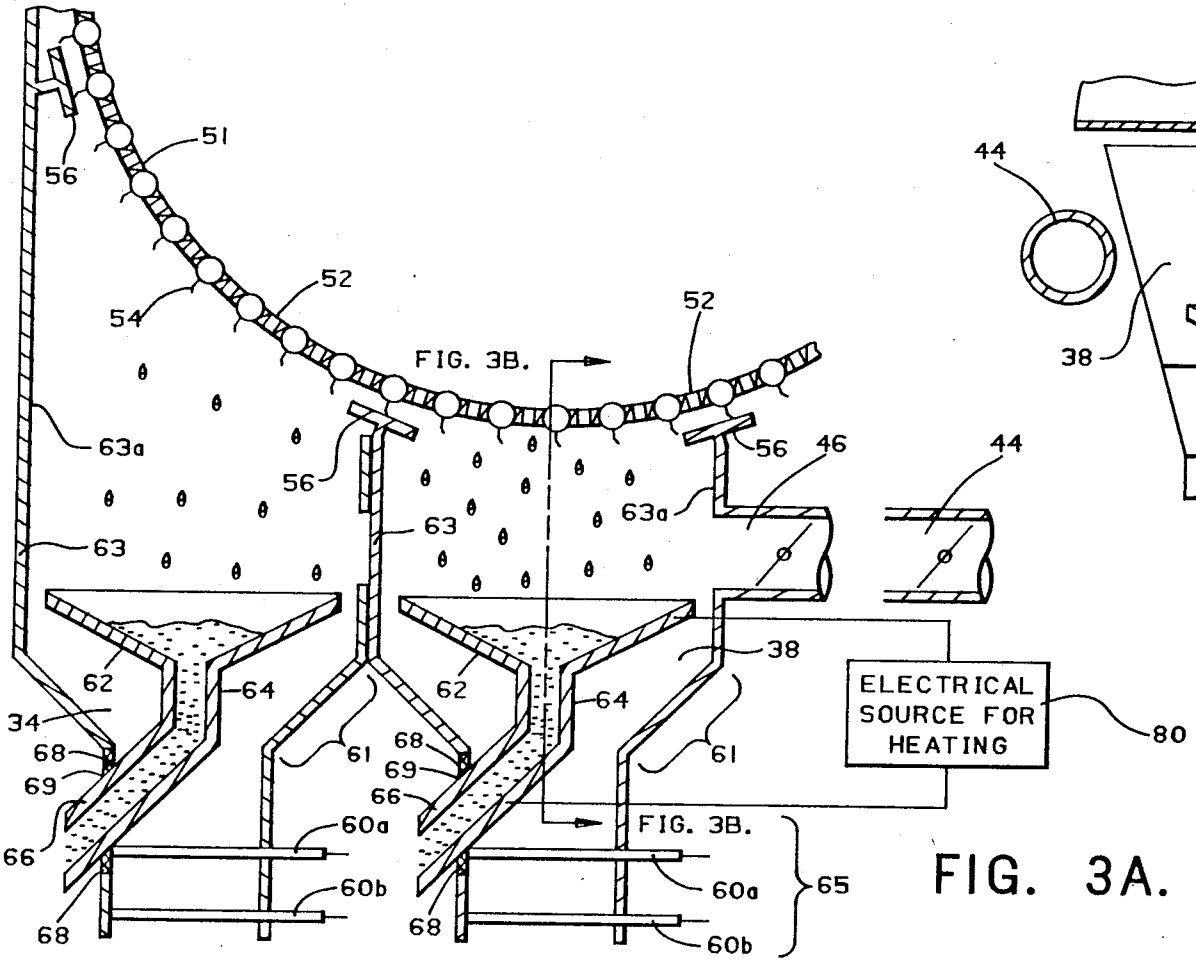
FIG. 3A is a schematic, cross-sectional and elevational view in a plane transverse to the axis of an associated rotary combustor, of windboxes and a segment of a combustion barrel in the associated rotary combustor, in accordance with a first embodiment of the present invention.

A first embodiment of the present invention is illustrated in FIGS. 3A and 3B in which the heatable contact surface forms a funnel 62 with a downwardly extending tube 64 that discharges the molten aluminum captured by the funnel 62. An electrical source for heating 80 maintains the heatable contact surface 62, 64 and pipes 66 above 660° C. The pipes 66 are coupled and sealed to the tube 64, pass through the walls of windboxes 34 and 38 at apertures 69 and are separated from the side walls 63 of the windboxes 34, 38 by insulation 68.

Figure 4:
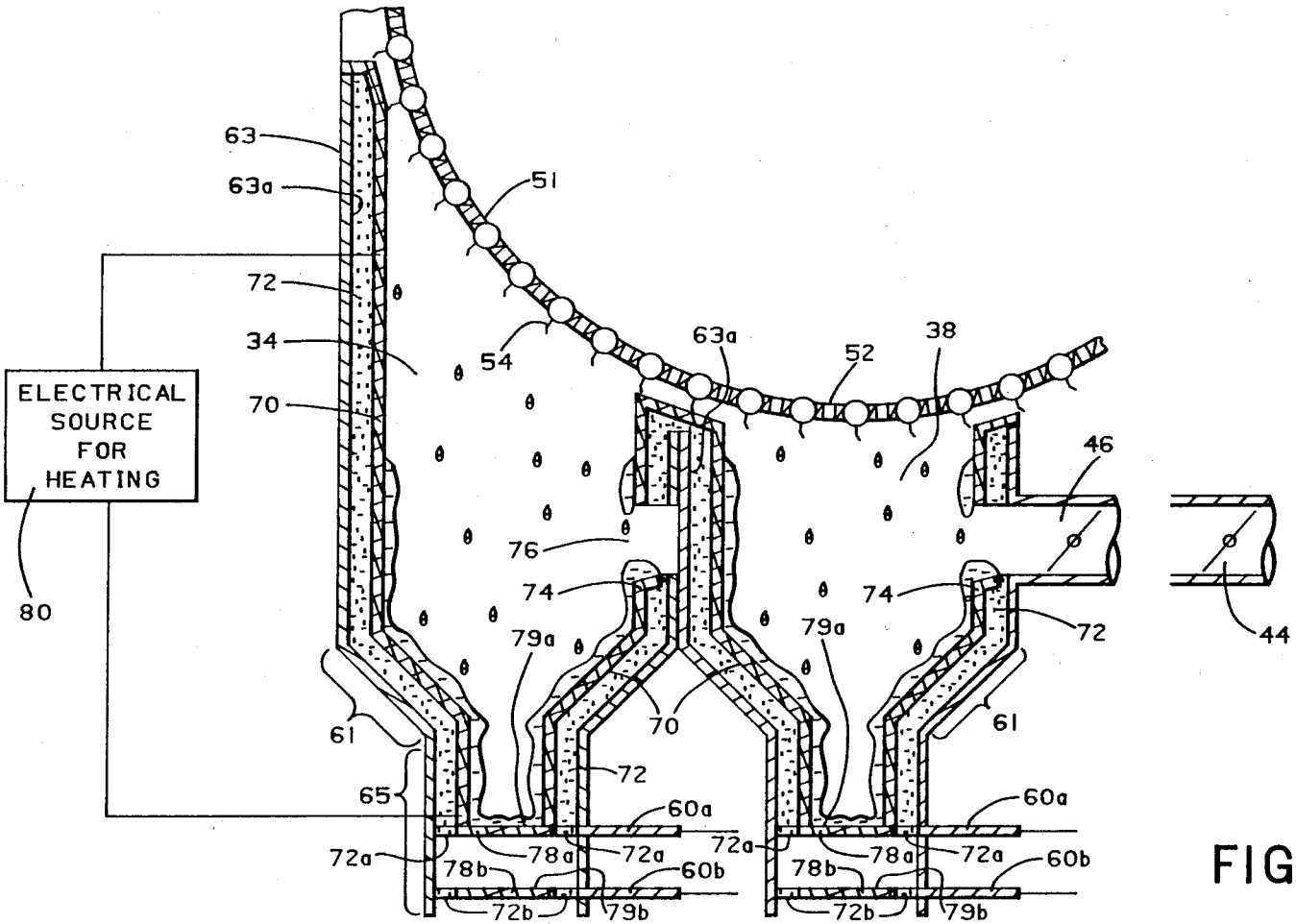
FIG. 4 is a schematic, cross-sectional and elevational view in a plane transverse to the axis of an associated rotary combustor, of windboxes and a segment of a combustion barrel in the associated rotary combustor in accordance with a second embodiment of the present invention.

A second embodiment is illustrated in FIG. 4, in which heatable contact surfaces 70 line the interior surface 63*a* of the side walls 63 of each of the windboxes 34 and 38 and are separated therefrom by insulation 72. The contact surfaces 70 may have a beveled portion 74 near the opening 76 connected to the control duct 44 or 46 to ensure that the molten aluminum does not accumulate excessively in the opening 76. The airlock doors 60*a* and 60*b* include heatable portions 78*a* and 78*b*, respectively, in their central areas spanning the open area between the insulated and heatable contact surfaces 70 to maintain the molten aluminum which accumulates on the upper surfaces 79*a* and 79*b*, respectively, in a molten state until it is removed. Removal preferably is performed by first opening airlock door 60*a* while door 60*b* remains closed, and then opening airlock door 60*b* after door 60*a* is closed. The airlock doors 60*a* and 60*b* may be of any conventional type, and thus may be mounted for sliding movement as schematically indicated in FIG. 4, to permit the described selective opening thereof, or may be hinged at one end so that the molten aluminum slides off.

In FIG. 4, the heated portion 78*b* is in the center of airlock door 60*b*, separated from the walls of the windbox 72 by heat insulation 72*b*. Thus, airlock doors 60*a* and 60*b* are constructed identically. This is preferable both for convenience of manufacturing and because aluminum is present in the region between the airlock doors 60*a* and 60*b*, only during the time period between alternate and successive openings of the airlock door 60*a* and the airlock door 60*b*, typically a few minutes or less. It is, of course, possible to extend the heated surface 70 and insulation 72 into this region, and even below airlock door 60*b*, if desired.

The simplest means of heating the contact surfaces 62, 64 and 70 is to use electrical resistance. For this purpose, an electrical source 80 for heating is connected to the heatable contact surfaces 62, 64 and 70 by heating elements which may be similar to the heating elements on electric ranges. In other words, the heating elements may include a core having a high electrical resistance, surrounded by cladding formed of a material which is a relatively poor conductor of electricity and a relatively good conductor of heat. The heatable contact surfaces form an outer layer on at least one side of the heating elements and may be formed from inexpensive stainless steel.

The many features and advantages of the present invention are apparent from the detailed specification and thus, it is intended by the appended claims to cover all such features and advantages of the device which fall within the true spirit and scope of the invention. Further, since numerous modifications and changes will readily occur to those skilled in the art, it is not desired to limit the invention to the exact construction and operation illustrated and described. Accordingly, all suitable modifications and equivalents may be resorted to falling within the scope and spirit of the invention.

What is claimed is:

1. An apparatus for preventing solidification of molten metal in particulate matter dropping from a combustion barrel and accumulating in a windbox of a rotary combustor, said apparatus comprising:

a heatable contact surface disposed inside the windbox;

means for supporting said heatable contact surface in the windbox with said heatable contact surface disposed in the path of molten metal dropping from the combustion barrel and for separating said heatable contact surface from the windbox; and means for heating said heatable contact surface above the temperature of said supporting means, above the temperature of gases inside the windbox and above the temperature of the particulate matter dropping on said heatable contact surface.

2. An apparatus as recited in claim 1, further comprising means for discharging the molten metal from the windbox through said supporting means.

3. An apparatus as recited in claim 2, wherein:

said heatable contact surface has a funnel shape with a downwardly extending tube;

said discharging means comprises a pipe coupled and sealed to the downwardly extending tube and exiting the windbox; and said heating means further comprises means for heating said pipe.

4. An apparatus as recited in claim 3, wherein:

said heatable contact surface is formed of stainless steel;

said heated pipe has an inner surface formed of stainless steel; and said heating means includes means for heating said heatable contact surface and said heated pipe with heat generated by an electric current flowing through a resistance.

5. An apparatus as recited in claim 3, wherein:

the windbox has a side wall with an aperture therein; and said supporting means comprises heat insulation disposed in the aperture between said pipe and the side wall of the windbox.

6. An apparatus as recited in claim 1, wherein:

the windbox has an interior surface;

said supporting means comprises heat insulation covering a significant portion of the interior surface of the windbox; and said heatable contact surface is generally disposed on said heat insulation, said heatable contact surface substantially conforming to the interior surface of the windbox.

7. An apparatus as recited in claim 6, wherein:

the windbox has a lower end, said heatable contact surface surrounding an open area in the lower end of the windbox; and said apparatus further comprises airlock doors, disposed at the lower end of the windbox, having a heatable portion spanning the open area surrounded by said heatable contact surface, the molten metal being discharged from the windbox by alternate and successive openings of said airlock doors.

8. An apparatus as recited in claim 7, wherein:

said heatable contact surface is formed of stainless steel; and said airlock doors have upper surfaces, facing the combustion barrel, formed of stainless steel.

9. A rotary combustor for burning solid material to produce heat that is transferred to heat exchanging equipment coupled to said rotary combustor, said rotary combustor comprising:

a combustion barrel comprising a generally cylindrical side wall rotatable about a central axis of rotation, said side wall comprising plural cooling pipes, extending longitudinally in spaced, parallel axial relationship, and plural gas-porous interconnections extending longitudinally, each of said gas-porous interconnections being disposed intermediate an adjacent pair of said cooling pipes and rigidly interconnecting same;

coupling means, coupled and sealed to the heat exchanging equipment and said cooling pipes, for supplying low-temperature coolant to said cooling pipes and for discharging high-temperature coolant from said cooling pipes to the heat exchanging equipment; and supply and discharge means for supplying combustion air to said combustion barrel through said gas-porous interconnections and for discharging molten metal dropping through said gas-porous interconnections, said supply and discharge means comprising:

windboxes, disposed underneath said combustion barrel generally perpendicular to the central axis of rotation;

heatable contact surfaces, each disposed in one of said windboxes and having a funnel shape with a downwardly extending tube, for collecting the molten metal into the downwardly extending tube;

pipes, each of said pipes coupled to the downwardly extending tube of one of said heatable contact surfaces and exiting a corresponding one of said windboxes, for supporting said heatable contact surfaces at the generally horizontal center of the corresponding one of said windboxes and discharging the molten metal, collected by said heatable contact surfaces, from said windboxes;

heat insulation separating said pipes from said windboxes at adjoining points; and means for heating said heatable contact surfaces and said pipes above the temperature of said windboxes at the adjoining points, above the temperature of gases in said windboxes and above the temperature of the metal collected by said heatable contact surfaces.

10. A rotary combustor for burning solid material to produce heat that is transferred to heat exchanging equipment coupled to said rotary combustor, said rotary combustor comprising:

a combustion barrel comprising a generally cylindrical side wall rotatable about a central axis of rotation, said side wall comprising plural cooling pipes, extending longitudinally in spaced, parallel axial relationship, and plural gas-porous interconnections extending longitudinally, each of said gas-porous interconnections being disposed intermediate an adjacent pair of said cooling pipes and rigidly interconnecting same;

coupling means, coupled and sealed to the heat exchanging equipment and said cooling pipes, for supplying low-temperature coolant to said cooling pipes and for discharging high-temperature coolant from said cooling pipes to the heat exchanging equipment; and supply and discharge means for supplying combustion air to said combustion barrel through said gas-porous interconnections and for discharging molten metal dropping through said gas-porous interconnections, said supply and discharge means comprising:

windboxes, having interior surfaces and lower ends, disposed underneath said combustion barrel generally perpendicular to the central axis of rotation;

heat insulation, formed on the interior surfaces of said windboxes;

heatable contact surfaces, substantially conforming to the interior surfaces of said windboxes and surrounding an open area in the lower end of each of said windboxes, for receiving the metal dropping through said gas-porous interconnections;

heating means for heating said heatable contact surfaces above the temperature of said heat insulation, above the temperature of the interior surfaces of said windboxes, above the temperature of gases passing through said windboxes and above the temperature of the metal dropping on said heatable contact surfaces; and airlock doors, two of said airlock doors disposed at the lower end of each windbox, each of said airlock doors having a heatable portion spanning the open area surrounded by said heatable contact surfaces, the molten metal being discharged by alternate and successive openings of the airlock doors.

11. An apparatus as recited in claim 1, wherein:

said heating means comprises means for heating said heatable contact surface using electrical current flowing through a resistance; and said heatable contact surfaces are heated above the melting point of the metal dropping thereon.

12. An apparatus as recited in claim 9, wherein:

said heating means comprises means for heating said heatable contact surface using electrical current flowing through a resistance; and said heatable contact surfaces are heated above the melting point of the metal dropping thereon.

13. An apparatus as recited in claim 10, wherein:

said heating means comprises means for heating said heatable contact surface using electrical current flowing through a resistance; and said heatable contact surfaces are heated above the melting point of the metal dropping thereon.

* * * * *